United States Patent [19]

Bauer et al.

[11] Patent Number: 4,660,325

[45] Date of Patent: Apr. 28, 1987

[54] FLEXIBLE WINDOW REGULATOR ASSEMBLY

[75] Inventors: Barney J. Bauer, Sylvania; William E. Buehler, Toledo; Gregory A. Wingate, Bowling Green, all of Ohio

[73] Assignee: Dura Corporation, Toledo, Ohio

[21] Appl. No.: 779,942

[22] Filed: Sep. 25, 1985

[51] Int. Cl.[4] ..... E05F 11/48

[52] U.S. Cl. ..... 49/352; 49/360

[58] Field of Search ..... 49/352, 349, 360

[56] References Cited

U.S. PATENT DOCUMENTS

| | | | |
|---|---|---|---|
| 1,606,712 | 11/1926 | McArthur | 49/352 X |
| 2,501,092 | 3/1950 | Rappl | 268/125 |
| 2,555,859 | 6/1951 | Rappl et al. | 268/129 |
| 2,615,711 | 10/1952 | Niquette | 268/130 |
| 2,640,682 | 6/1953 | Votypka | 254/141 |
| 2,907,564 | 10/1959 | Wise | 268/124 |
| 2,987,937 | 6/1961 | Sala | 74/505 |
| 3,281,991 | 11/1966 | Colell | 49/360 X |
| 3,403,474 | 10/1968 | Spasoff | 49/360 |
| 3,890,743 | 6/1975 | Eckhardt et al. | 49/352 |
| 4,095,370 | 6/1978 | Muehling | 49/352 |
| 4,110,935 | 9/1978 | Sessa | 49/352 |
| 4,171,594 | 10/1979 | Colanzi | 49/349 |
| 4,199,899 | 4/1980 | Muhling et al. | 49/352 |
| 4,222,202 | 9/1980 | Pigeon | 49/352 |
| 4,235,046 | 11/1980 | Hess et al. | 49/352 |
| 4,306,378 | 12/1981 | Fukura et al. | 49/352 |
| 4,314,692 | 2/1982 | Brauer et al. | 49/352 X |
| 4,403,450 | 9/1983 | Ishii | 49/352 |
| 4,406,089 | 9/1983 | Koch et al. | 49/352 |
| 4,428,542 | 1/1984 | Kobayashi et al. | 242/54 R |
| 4,433,509 | 2/1984 | Seppaca | 49/352 |
| 4,440,354 | 4/1984 | Kobayashi et al. | 242/54 R |
| 4,480,409 | 11/1984 | Hara | 49/352 |
| 4,494,336 | 1/1985 | Ishii et al. | 49/352 |
| 4,534,233 | 8/1985 | Hamaguchi | 49/352 X |
| 4,547,993 | 10/1985 | Kobayashi et al. | 49/352 |

FOREIGN PATENT DOCUMENTS

| | | | |
|---|---|---|---|
| 2100791 | 1/1983 | United Kingdom | 49/352 |

*Primary Examiner*—Philip C. Kannan

*Attorney, Agent, or Firm*—Hugh Adam Kirk

[57] ABSTRACT

This disclosure deals with a window regulator assembly as a unit such as for vehicles and specifically vehicle doors, which doors have rigid frames so that the assembly may be installed in any type or shape of door, and the three parts of this assembly that are attached to any adjacent panel in the door after the door or wall in which it is to be installed has already been assembled. This assembly comprises a flexible plastic tape which may be twisted and bent in any direction, the opposite ends of which tape are wrapped around reversible motor or manually-driven drums so that as one end is wrapped, the other is unwrapped, and vice versa. These drums comprise the driving part of this assembly that is attached to a door. The tape also has a substantially straight vertical reach intermediate its ends, the length of which reach may be fixed by the length of a flexible plastic strip along this reach of the tape. This vertical reach of tape or strip has guides at its ends that comprise the two other parts of this assembly, which guides preferably surround the tape to insure the assembly as a unit. These two guide parts are attached to the door and are for changing the direction of the tape to extend toward the drums. A crimping and clamping device is attached to the straight vertical reach of the tape and to a carrier for the window that is to be opened and closed or regulated by the reciprocation of this vertical reach of tape. The tension in the tape is maintained by resiliently supported rollers in contact with the tape away from this substantially straight reach, which rollers may be mounted on the driving part or on a fourth part of this unitary assembly that also is separately attached to a door.

22 Claims, 7 Drawing Figures

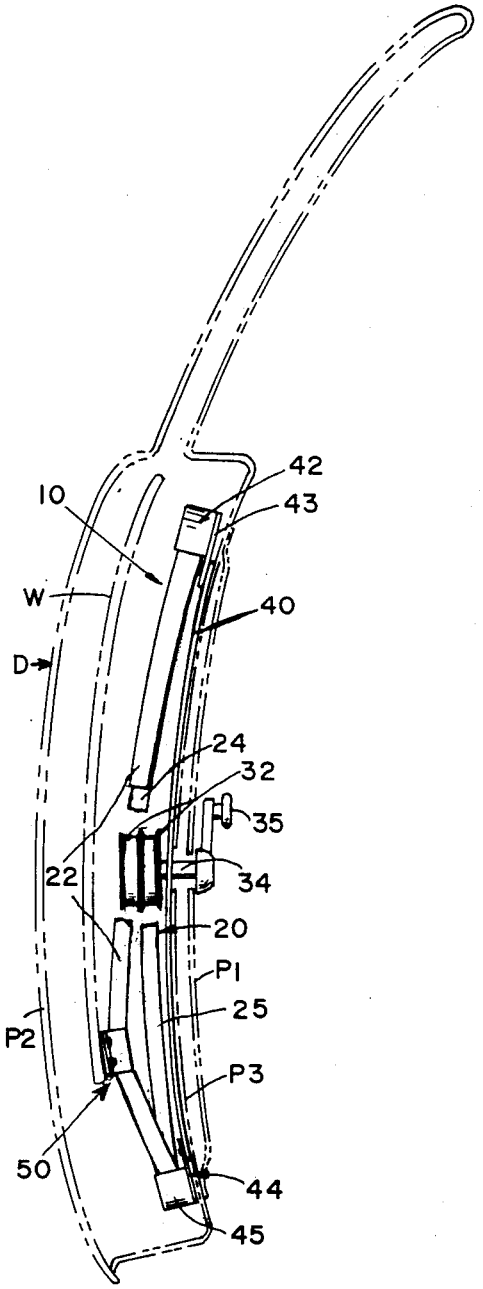
Fig II
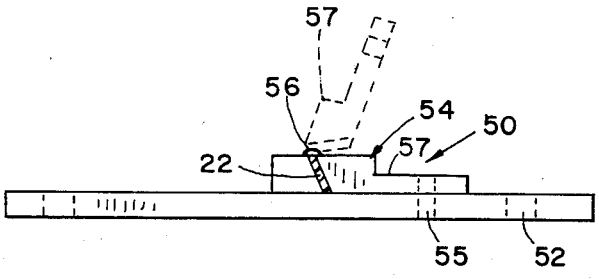
Fig IV
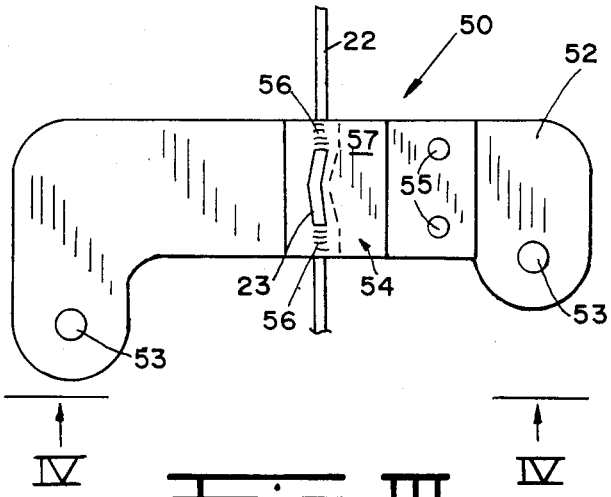
Fig III

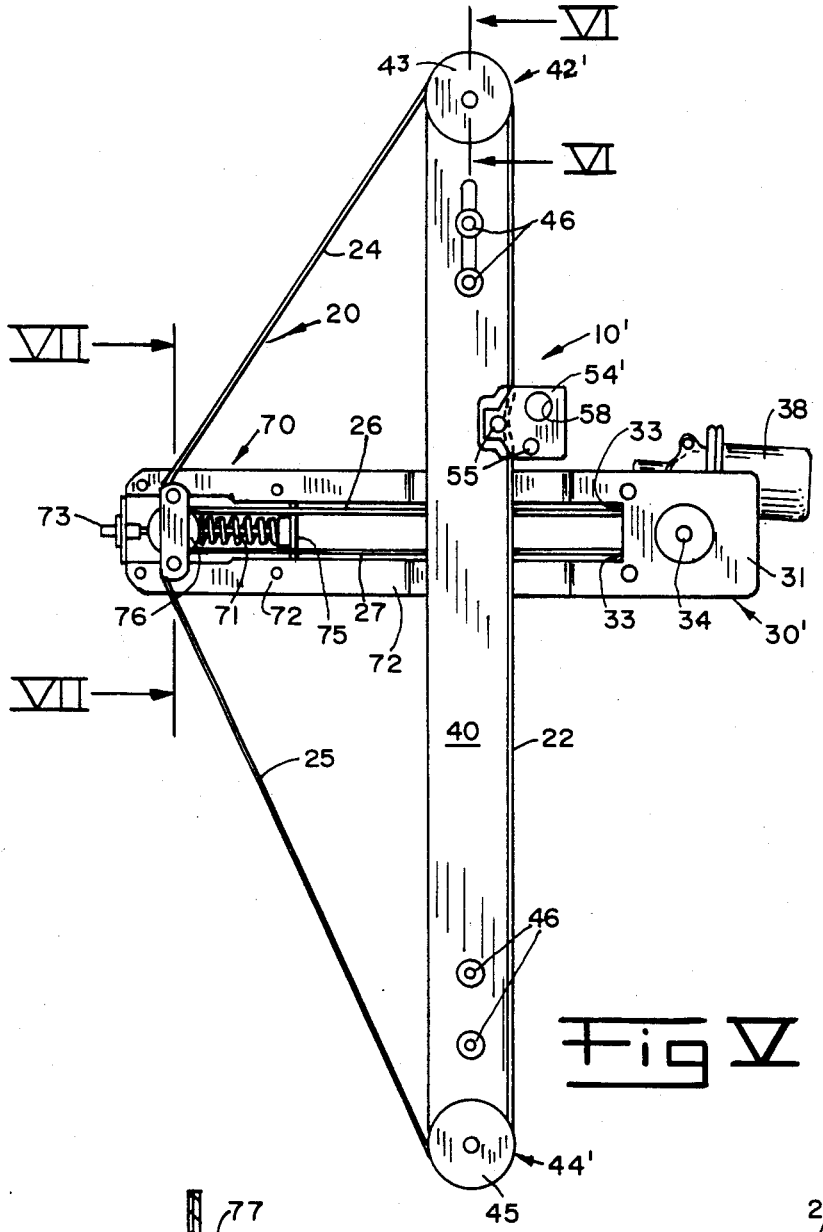
Fig V
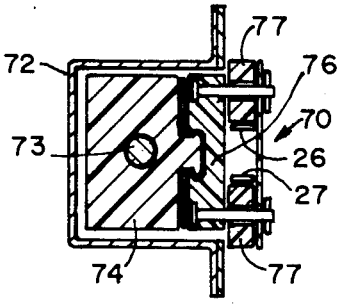
Fig VII
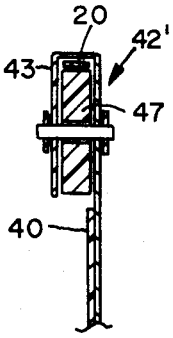
Fig VI

FLEXIBLE WINDOW REGULATOR ASSEMBLY

BACKGROUND OF THE INVENTION

Previously, many different types of flexible linear means have been provided for regulating windows in vehicle doors. However, most of such prior devices required special rigid means for guiding the flexible linear means, particularly in the direction that they would regulate or reciprocate the window to which they were attached. Such regulators either had to be installed in the door during or prior to its complete assembly, or had to be mounted on a rigid frame which could be placed into the door or wall to insure proper guiding of the flexible linear means. These flexible linear means usually were provided with notches or teeth to insure their positive drive. However, closed loops which had portions wrapped around pulleys, reels or drums, also in most instances required rigid guides for their vertical reaches that were connected to the windows, particularly if the windows were not provided with their own guide means. Furthermore, although there are a few recent devices which permit flexible linear driving means, such as cables or tapes, to be flexed to compensate for arcuate paths of convex windows in vehicle doors, rigid frames still were provided for the window regulator assemblies, and particularly rigid guides for the carriers for the windows, which carriers were attached to the reach of cable or tape that positively reciprocated the windows.

SUMMARY OF THE INVENTION

Generally speaking, the flexible window regulator assembly of this invention is for guided windows in walls which move over arcuate or non-planar paths, such as in the doors of automobiles. This assembly comprises at least three separate parts which can be moved angularly and/or relatively with respect to each other, so they can be fitted in any aperture that may be provided in a wall for their insertion and proper location for attachment to a panel of that wall and to a guided arcuate window for its regulation. These parts also are interconnected by a flexible tape, preferably of plastic and imperforate, which tape is longitudinally reciprocable for regulating the window. Thus one of these parts comprise a reversible pair of drums for driving the tape, and two other of these parts comprise guides for changing the direction of the tape from the ends of a continuous longitudinal and substantially straight and usually vertical reach of tape for connection to the window. These guides direct the tape to the part having the drums and their manual or reversible motor driving means. These two guides also preferably surround the tape and may be interconnected with a flexible plastic strip for properly spacing the guides and shielding the substantially straight reach of the tape.

An additional and tensioning part may be provided along the tape away from the reach connected to the window. This tensioning part may comprise one or more spring-urged rollers mounted on a lever or slide attached to the driving part or on a part separately attached to the door or wall panel, or the spring may be mounted in the drums themselves.

A specific crimping and clamping plastic jaw mounted on a carrier attached to the lower edge of the window, comprises the connection between the continuous longitudinal reach of tape and the window to be regulated or opened and closed by this assembly.

The mechanism for reversibly driving the tape preferably comprises a pair of adjacent interconnected drums, reels or pulleys upon which opposite ends of the flexible tape are wrapped. Thus when the drums are rotated in one direction, one end of the tape will be pulled and wrapped around a drum while the other end will be unwrapped from the other drum, and vice versa when the drums are rotated in the opposite direction. This reciprocates the substantially straight reach of tape connected to the window to raise and lower or regulate the window. This pair of drums may be driven manually by a crank directly connected to their common axle, or they may be driven by a reversible electric motor through a reduction gear mechanism, such as a worm drive.

The plastic strip that spaces the guides or pulleys at opposite ends of the substantially straight reach of tape which is connected to the window, also acts as a shield for the edge of the tape from being abraded by any adjacent sharp edges of the wall panels to which the assembly is connected.

Because of the flexibility of this guide connecting strip and the separate parts of this assembly interconnected only by a flexible and twistable plastic tape, this assembly is readily adaptable for insertion into apertures provided in panels in a wall or door, and also for guiding a window over a non-linear path, such as a convex window along arcuate guides, regardless of the curvature to which the particular window is guided.

OBJECTS AND ADVANTAGES

Accordingly, it is an object of this invention to provide a simple, efficient, effective, economic and flexible window regulator assembly held together as a unit by a flexible plastic driving tape.

Another object of this invention is to provide a unit assembly of a window regulator which can be fitted into different shape and size pre-assembled walls and doors of vehicles for operating non-planar windows.

Another object is to provide a window regulator assembly which has not rigid frame and employs a flexible continuous tape drive which can positively drive windows over non-linear paths, and which can have its parts connected to any available panel in the wall adjacent the window.

Still another object is to provide novel tensioning means for the tape which reduce the bending of the tape when the tape is under tension.

A further object is to provide a protective shield for the reach of tape that drives a window, to prevent abrasion of the tape against adjacent parts inside the wall where it is mounted.

A still further object is to provide a novel crimping and clamping means for connecting a flexible tape to a carrier for operating a window.

BRIEF DESCRIPTION OF THE VIEWS

The above mentioned and other features, objects and advantages, and the manner of attaining them are described more specifically below by reference to embodiments of this invention shown in the accompanying drawings wherein:

FIG. I is a side elevation of a reversible electric motor-driven window regulator assembly according to one embodiment of this invention, which assembly is shown mounted in the front side door of a vehicle shown in dot-dash lines with its window in its open position in the door panel or wall;

FIG. II is an enlarged view of the edge of the assembly shown in FIG. I taken in the directions of the arrows II—II in FIG. I with parts broken away, but instead of an electric motor drive therefor, a manual crank is shown;

FIG. III is an enlarged plan view of the carrier for the window shown in FIG. I and its connector to the vertical reach of tape of the regulator assembly of this invention;

FIG. IV is a side elevational view of the carrier with its crimping and clamping connection shown in FIG. III, with its clamp being shown open in dotted lines;

FIG. V is a side elevational view of another embodiment of a motor-driven window regulator assembly for a front left door of a vehicle showing another type of tensioning means and another type of guiding means from those shown in FIG. I;

FIG. VI is an enlarged sectional view taken along lines VI—VI of FIG. V of a guiding pulley for reversing the tape at the end of its vertical reach, and shows a housing that surrounds the tape; and FIG. VII is an enlarged sectional view taken along line VII—VII of FIG. V of the pivoted or turret mounting for the pulleys of the tape tensioning means that is mounted on a rigid extension of the driving part of the assembly of this other embodiment of this invention.

DETAILED DESCRIPTION OF PREFERRED EMBODIMENTS

Figure 1:
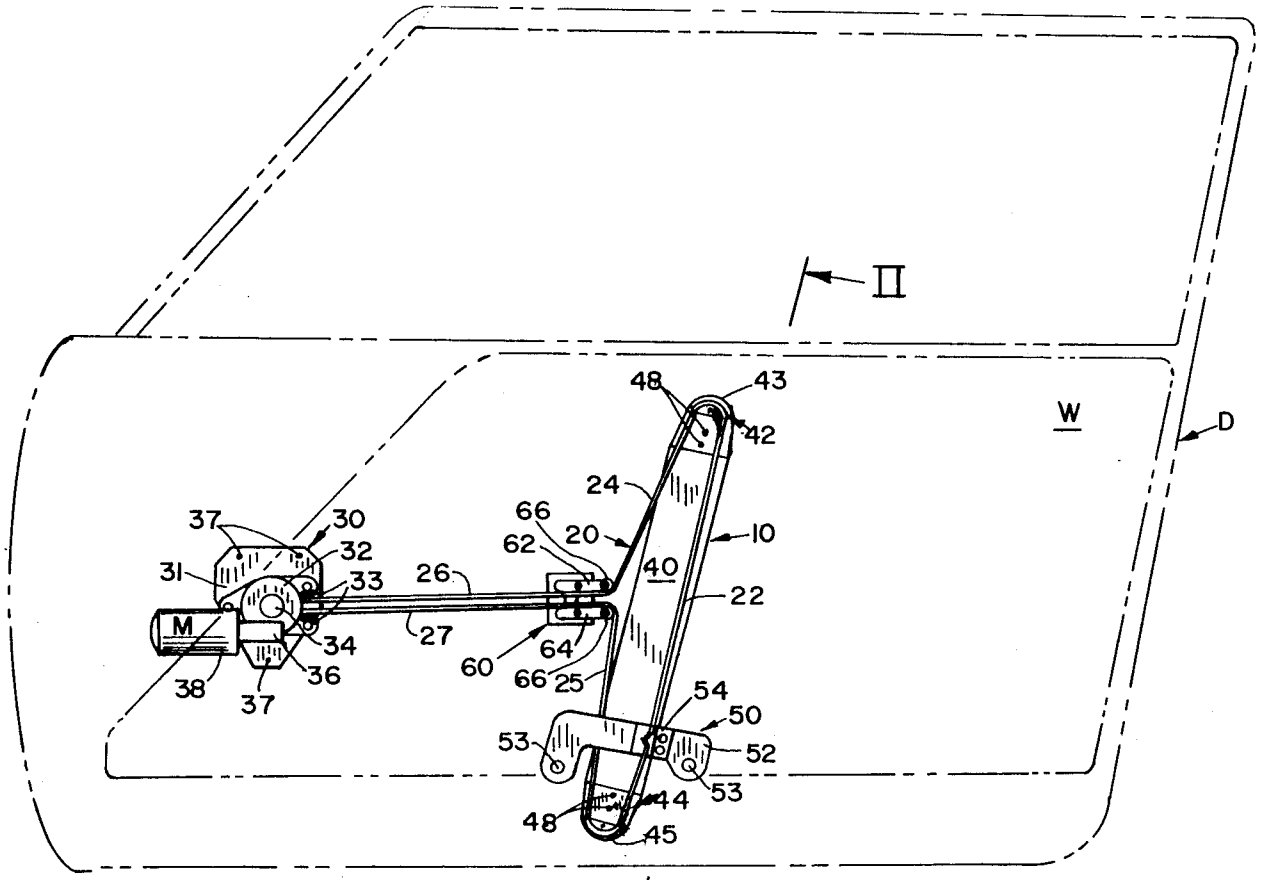

Referring first to FIGS. I and II, there is shown in dot-dash lines a convex automobile door D with a window W in its open position in the door, all shown in dot-dash lines. The edges of the door frame act as guides for the window W. The end view of the door D shown in FIG. II discloses the door wall to be made up of inner and outer panels P1 and P2, respectively, and an intermediate panel P3 to which panel P3 the parts of the assembly of this invention are attached.

In full lines in FIGS. I and II, and FIG. V, there are shown two embodiments of the window regulator assemblies 10 and 10' of this invention, respectively. These embodiments each comprises a flexible plastic imperforate tape 20, the opposite ends of which are connected to a driving reel or drum sub-assembly or part 30 or 30'. This tape 20 has a continuous longitudinal substantially straight and vertical reach 22 adjacent which reach may be a flexible plastic spacing and shielding strip 40. The opposite ends of this spacing strip 40 are provided with guides 42 or 42' and 44 or 44', respectively, for changing, and herein reversing, the direction of the tape 20. The continuous substantially vertical reach of tape 22 is connected to the lower edge of the window pane W by means of a carrier 50 including a tape clamping device 54 or 54' which is shown in more detail in FIGS. III, IV and V and will be described later. There is also shown in FIGS. I and V, and FIG. VII separate tape tensioning devices 60 and 70 which are, respectively, either separately mounted to a panel in a door, or to an extension 72 on the driving part 30'.

Referring now in more detail to the parts of the assemblies 10 and 10' of this invention, the continuous imperforate flexible driving plastic tape 20, for example, may be one manufactured by E. I. DuPont de Nemours & Company, Inc. under their registered trademark "DYMETROL" for copolyester elastomeric mechanical drive tape. This driving tape 20 also ties the parts of the assembly together as a unit. In the embodiment in FIG. I the general configuration of the tape 20 when installed into the door D is that of a "T". However, it can take the form of a triangle as shown in the embodiment in FIG. V, or in the form of an "L", or other shape that may be required for fitting the parts 30, 42 or 42', and 44 or 44' of the assembly onto a wall panel.

In the embodiments herein shown, opposite ends of the tape 20 are wrapped around two adjacent reels or drums 32 of the parts 30 and 30', which drums 32 herein are keyed to a common axle 34 together with a worm gear which is driven by a worm 36 on the shaft of a reversible electric motor 38. However, the common axle 34 for the drums 32 may be provided with a manual crank 35 as shown in the embodiment in FIG. II. This whole subassembly or part 30 or 30' may be mounted on a single plate 31 which is rigidly attached to the panel P3 such as by rivets or screws 37. Also there may be provided guide rollers 33 for the tape as it enters into the sub-assembly 30 and onto the spaced drums 32 (see FIG. II). One end of this tape 20 is anchored, such as in a slot in the drums by a set screw (not shown), and wrapped in one direction around one of the drums 32, and the other end of the tape 20 is similarly anchored to the other drum and wrapped around it in the opposite direction. Thus when the axle 34 is rotated, one drum 32 will wind up the tape while the other will unwind it, thus giving a positive pull in each direction to the reciprocation of the substantially straight vertical reach 22 of the tape connected to the window W via the carrier 5 for opening and closing the window W.

One of the important features of this invention is the straight strip 40 of a flexible plastic which extends parallel to and along one side of the substantially straight vertical reach 22 of the tape 20. This strip 40 has adjustably attached at its ends the guide parts or means 42 or 42' and 44 or 44', such as by fasteners 46 in a slot as shown in FIG. V. These tape reversing guides 42 and 44 may be substantially U-shaped frictionless shoes as shown in FIG. I or the tape reversing guides 42' and 44' may be pulleys or rollers 47 as shown in FIGS. V and VI. These guide means 42 or 42' and 44 or 44' have covers 43 and 45 over their outer ends which surrounds the tape to fasten the guide parts or means 42 or 42' and 44 or 44' to the flexible tape 20 to insure the unity of the assembly of this invention. Also these covers 43 and 45 provide U-shaped tunnels for guiding opposite ends of the tape 20 toward the driving part 30 or 30' to the drums 32. The flexible connector or strip 40 not only spaces the two reversing guides 42 or 42' and 44 or 44', respectively, for the tape 20, but also permits the unitary assembly to be folded and inserted in apertures between panels in the door after the door is assembled. However, once it is in place, it is important that the two ends or guide parts 42 or 42' and 44 or 44' be anchored to a door panel, such as by means of the rivets or screws 48 (see FIG. I).

Since the reciprocation of the substantially straight vertical reach 22 of the tape is employed for opening and closing or regulating the window W, there must be a connection between this reach 22 of the tape and the window W. This connection 50 comprises a carrier plate 52 which is attached to the lower edge of the window W, such as by pins 53 and/or an adhesive. On this carrier plate 52 is mounted a crimping and clamping device 54 or 54', such as by means of rivets or screws 55, which rivets and screws may also hold the jaws of the clamping and crimping device 54 together. This tape clamping and crimping device puts an obtuse bend 23 in the tape 22 and clamps it there. One crimping and clamping means 54 shown in FIGS. I, III and IV comprises a pair of jaws composed of one piece of plastic having a plastic hinge at 56 for permitting the upper jaw portion 57, shown in dotted lines in FIG. IV, to be raised so that the tape 22 can be inserted in between cooperating obtuse angle mating jaws of these portions to crimp the tape 22 as shown in FIG. III at 23 and clamp it from slipping with respect to the carrier plate 52. This clamping position is secured also by the rivets or screws 55. When the regulator 10 or 10' is installed inside the wall, it is connected to window carrier plate 52 in FIG. I by the fasteners 55, and in FIG. V the crimping and clamping device 54' may be fastened to a carrier plate 52 by means of a fastener through the aperture 58.

As shown in FIG. II, the panel of the door is arcuate as is the glass window W, and this window W is guided along its edges by the frame of the door so that no guide means is required for the reach 22 on the tape 20. Since this tape 20, however, is flexible and can be twisted as well as bent sideways as shown in FIG. II, it is readily adaptable to irregular and non-planar reciprocating movements for a carrier plate 52 connected to a convex window W. Thus the alignment of the vertical reach 22 is different from that of the reaches 24 and 25 after they pass over the reversing guides 42 or 42' and 44 or 44'.

Once the three major parts 30 and guides 42 or 42' and 44 or 44' at opposite ends of the flexible strip 40 are anchored or fastened to a panel P3 in a wall or door D, it is important that the tape 20 be maintained taut to operate efficiently, smoothly and directly in response to the driving mechanism of the reversible motor 38 or crank 35. Such tensioning means may be provided inside of the drums 32 by a spring ratched mechanism (not shown), or by compression springs in one or both of the guides 42 or 42' and 44 or 44' (not shown). Also the tensioning means may comprise additional part 60 attached to the door panel P3 as shown in FIG. I, or by a part 70 attached onto a rigid extension of the driving part 30' as shown in FIG. V.

The part 60 in FIG. I comprises a pair of pivoted levers 62 and 64 with rollers 66 at their outer ends engaging the tape. These rollers 66 are urged toward each other, such as by a U-shaped spring between and acting on these levers to maintain the tension in the tape 20. Thus the reversed reaches 24 and 25 of the tape 20 extend around the adjacent insides of the rollers 66 on the levers 62 and 64, before further extending as reaches 26 and 27 to the rollers 33 at the entrance of the driving tapes or drums 32.

In FIGS. V and VII there is shown another embodiment of a tape tensioning device 70 which may be rigidly attached to an extension 72 from the base 31 of the driving part 30'. The extension at its outer end may comprise a channel in which a compression spring 71 is axially mounted around a guiding rod 73. This spring 71 urges a turret base 74 to slide outwardly on said rod 73 from a stop 75 in the extension 72. Swivelly mounted on the turret base 75 is an oscillatable turret 76 which has a pair of diametrically-spaced rollers or pulleys 77 thereon for guiding the reverse reaches 24 and 25 and 26 and 27 of the tape back toward the drums 32, as well as maintaining tension in the tape 20. The separate levers 62 and 64 in FIG. I, as well as the swivel-mounted spaced pulleys or rollers 77 reduce sharpness of the bend in the tape 20 when the adjacent reaches thereof are under tension.

Although many of the parts above mentioned are made of plastic because of its properties of flexibility and formability, it should be understood that these parts may be made of other materials and of different types of plastics than the specific ones mentioned, without departing from the scope of this invention.

While there is described above the principles of this invention in connection with specific apparatus, it is to be clearly understood that this description is made only by way of example and not as a limitation to the scope of this invention.

We claim:

1. A window regulator assembly for windows guided in walls along arcuate paths, said assembly comprising:

(a) a flexible tape having two ends and a substantially straight continuous reach, (b) means for connecting said reach to a window, (c) a flexible plastic strip along said reach having means at its ends for guiding and changing the direction of said tape, (d) drum means attached to said ends of said tape so that rotation of said drum wraps one end of said tape while unwrapping the other end, and vice versa, (e) means for reversibly rotating said drum for reciprocating said reach of tape to open and close said window in said wall, (f) means apart from said reach for maintaining tension in said tape, and (g) means for separately attaching said drum and the ends of said strip in said wall.

2. An assembly according to claim 1 wherein said wall is a vehicle door.

3. An assembly according to claim 1 wherein said substantially straight continuous reach is substantially vertical.

4. An assembly according to claim 1 wherein said means for connecting said reach to said window comprises a tape crimping and clamping means.

5. An assembly according to claim 4 wherein said means for connecting said reach to said window comprises a carrier attached to an edge of said window and connected to said clamping means.

6. An assembly according to claim 1 wherein said drum means comprises a pair of reels fixed to the same axle and the ends of said tape are wrapped oppositely around their respective reels.

7. An assembly according to claim 1 wherein said drum means comprises a pair of drums connected together to which the ends of said tape are separately attached.

8. An assembly according to claim 1 wherein said means for reversibly rotating said drum means comprises a reversible electric motor and reduction gear mechanism.

9. An assembly according to claim 1 wherein said means for reversibly rotating said drum means comprises a hand crank.

10. An assembly according to claim 1 wherein said means for maintaining tension comprises a spring-urged roller against a reach of said tape between said straight continuous reach and said drum means.

11. An assembly according to claim 10 wherein said roller is mounted on a pivoted lever arm.

12. An assembly according to claim 1 wherein said means for guiding and changing the direction of said tape comprises a roller.

13. An assembly according to claim 1 wherein said means for guiding and changing the direction of said tape surrounds said tape to maintain said assembly as a unit.

14. A window regulator assembly for a vehicle window having a carrier along its lower edge, said assembly comprising:

(a) a flexible plastic tape having two opposite ends and substantially vertical reach, (b) means for anchoring said carrier to said vertical reach, (c) a flexible plastic shielding strip parallel to said vertical reach and having guide means at its upper and lower ends for engaging and changing the direction of said tape, (d) a drum means to which said opposite ends of said tape are anchored and around which drum means said ends are oppositely wrapped so that when said drum means is rotated it will pull on one end in one direction and let out the other end in the other direction, and vice versa, to reciprocate vertically and positively said vertical reach and said carrier for regulating said window, (e) means for reversibly rotating said drum means, (f) means for fastening said drum means and the upper and lower ends of said plastic strip to a panel of said vehicle, and (g) means for maintaining tension in said tape.

15. An assembly according to claim 14 wherein said means for anchoring said vertical reach to said window comprises a tape crimping and clamping means.

16. An assembly according to claim 15 wherein said means for anchoring said vertical reach to said window comprises a carrier attached to an edge of said window and connected to said clamping means.

17. An assembly according to claim 14 wherein said drum means comprises a pair of reels fixed to the same axle and the ends of said tape are wrapped oppositely around their respective reels.

18. An assembly according to claim 14 wherein said means for changing the direction of said tape comprises a roller.

19. An assembly according to claim 14 wherein said means for guiding and changing the direction of said tape surrounds said tape to maintain said assembly as a unit.

20. An assembly according to claim 14 wherein said means for reversibly rotating said drum means comprises a reversible electric motor and reduction gear mechanism.

21. An assembly according to claim 14 wherein said means for reversibly rotating said drum means comprises a hand crank.

22. An assembly according to claim 14 wherein said means for maintaining tension comprises a spring-urged roller against a reach of said tape between said substantially vertical reach and said drum means.

* * * * *

UNITED STATES PATENT AND TRADEMARK OFFICE

CERTIFICATE OF CORRECTION

PATENT NO. : 4,660,325

DATED : April 28, 1987

INVENTOR(S) : Barney J. Bauer et al

It is certified that error appears in the above-identified patent and that said Letters Patent are hereby corrected as shown below:

Column 4, line 31, change "5" to - - 50 - - .

Column 5, line 37, change "ratched" to - - ratchet - - .

Signed and Sealed this

Twenty-fifth Day of August, 1987

*Attest:*

DONALD J. QUIGG

*Attesting Officer*

*Commissioner of Patents and Trademarks*